US009641936B2

(12) United States Patent
Yu et al.

(10) Patent No.: US 9,641,936 B2
(45) Date of Patent: May 2, 2017

(54) INDOOR SOUND-MODULATING DEVICE

(71) Applicant: YI SHENG CO., LTD., Taoyuan (TW)

(72) Inventors: Jen-Fang Yu, Taoyuan (TW); Kun-Che Lee, Taoyuan (TW)

(73) Assignee: YI SHENG CO., LTD., Taoyuan (TW)

( * ) Notice: Subject to any disclaimer, the term of this patent is extended or adjusted under 35 U.S.C. 154(b) by 0 days.

(21) Appl. No.: 15/138,598

(22) Filed: Apr. 26, 2016

(65) Prior Publication Data

US 2016/0314777 A1 Oct. 27, 2016

(30) Foreign Application Priority Data

Apr. 27, 2015 (TW) ..... 104113445 A

(51) Int. Cl.

| | |
|---|---|
| ***G10K 11/16*** | (2006.01) |
| ***H04R 3/04*** | (2006.01) |
| ***H04R 29/00*** | (2006.01) |
| ***G10K 11/178*** | (2006.01) |

(52) U.S. Cl.

CPC ..... *H04R 3/04* (2013.01); *G10K 11/1784* (2013.01); *H04R 29/00* (2013.01); *G10K 2210/104* (2013.01); *G10K 2210/1054* (2013.01); *G10K 2210/511* (2013.01)

(58) Field of Classification Search

CPC ..... H04R 3/04; H04R 29/00; G10K 11/1784

See application file for complete search history.

(56) References Cited

U.S. PATENT DOCUMENTS

| | | | | |
|---|---|---|---|---|
| 2010/0039106 A1* | 2/2010 | Edelstein | ..... | G01R 33/05 324/253 |
| 2010/0173783 A1* | 7/2010 | Fermon | ..... | B82Y 25/00 505/160 |
| 2016/0111078 A1* | 4/2016 | Barath | ..... | G10K 11/1786 381/71.7 |

* cited by examiner

*Primary Examiner* — Simon King

(74) *Attorney, Agent, or Firm* — WPAT, PC; Justin King

(57) ABSTRACT

An indoor sound-modulating device is provided. The indoor sound-modulating device includes a low-frequency noise detector, an automatic actuator and an audio signal generator. The low-frequency noise detector detects low-frequency noise and generates a first modulating signal in response to the detected low-frequency noise. The automatic actuator issues a second modulating signal in response to a predetermined state. The audio signal generator generates a low-frequency audio signal for eliminating the low-frequency noise in response to the first modulating signal and generates a high-frequency repellent audio signal in response to the second modulating signal. The low-frequency audio signal has a frequency ranging from 20 Hz to 350 Hz, while the high-frequency repellent audio signal has a frequency not less than 8000 Hz.

10 Claims, 3 Drawing Sheets

INDOOR SOUND-MODULATING DEVICE

FIELD OF THE INVENTION

The present invention relates to an indoor sound-modulating device, and more particularly to an indoor sound-modulating device with automatic actuating function.

BACKGROUND OF THE INVENTION

Nowadays, the increasing demands for high indoor environmental quality such as sound quality inside the housing can not be ignored. However, in a densely populated city, the indoor sound quality is seriously affected due to various indoor and outdoor noise sources. No practicable device has been developed to solve this problem.

Therefore, there is a need to provide an indoor sound-modulating device to effectively eliminate the adverse influence.

SUMMARY OF THE INVENTION

The present application provides an indoor sound-modulating device for eliminating indoor noise or repelling people in specific conditions.

In accordance with an aspect of the present disclosure, an indoor sound-modulating device is provided. The indoor sound-modulating device includes a low-frequency noise detector, an automatic actuator and an audio signal generator. The low-frequency noise detector detects low-frequency noise and generates a first modulating signal in response to the detected low-frequency noise. The automatic actuator issues a second modulating signal in response to a predetermined state. The audio signal generator generates a low-frequency audio signal for eliminating the low-frequency noise in response to the first modulating signal and generates a high-frequency repellent audio signal in response to the second modulating signal. The low-frequency audio signal has a frequency ranging from 20 Hz to 350 Hz, while the high-frequency repellent audio signal has a frequency not less than 8000 Hz.

In an embodiment, the first modulating signal generated by the low-frequency noise detector and the low-frequency noise have similar waveforms in antiphase.

In an embodiment, the automatic actuator includes a motion detector for detecting whether an object is moving within a specific region and generating the second modulating signal if the predetermined state is met according to the detected moving object.

In an embodiment, the automatic actuator includes a timer for issuing the second modulating signal if the predetermined state representing a specific period of time is met.

In an embodiment, the audio signal generator includes an amplifier circuit and a speaker. The high-frequency repellent audio signal has an intensity not greater than 60 dB.

In accordance with another aspect of the present disclosure, an indoor sound-modulating device is provided. The indoor sound-modulating device includes a low-frequency noise detector and an audio signal generator. The low-frequency noise detector detects low-frequency noise and generates a first modulating signal in response to the detected low-frequency noise. The audio signal generator generates a low-frequency audio signal for eliminating the low-frequency noise in response to the first modulating signal. The low-frequency audio signal has a frequency ranging from 20 Hz to 350 Hz.

In accordance with a further aspect of the present disclosure, an indoor sound-modulating device is provided. The indoor sound-modulating device includes an automatic actuator and an audio signal generator. The automatic actuator issues a second modulating signal in response to a predetermined state. The audio signal generator generates a high-frequency repellent audio signal in response to the second modulating signal. The high-frequency repellent audio signal has a frequency not less than 8000 Hz and an intensity not greater than 60 dB.

In the indoor sound-modulating device of the present disclosure, the low-frequency noise detector is used for detecting low-frequency noise and generating a first modulating signal in response to the detected low-frequency noise. An automatic actuator is used for issuing a second modulating signal in response to a predetermined state. The audio signal generator generates a low-frequency audio signal for eliminating the low-frequency noise in response to the first modulating signal and generates a high-frequency repellent audio signal in response to the second modulating signal. The low-frequency audio signal has a frequency ranging from 20 Hz to 350 Hz, while the high-frequency repellent audio signal has a frequency not less than 8000 Hz.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
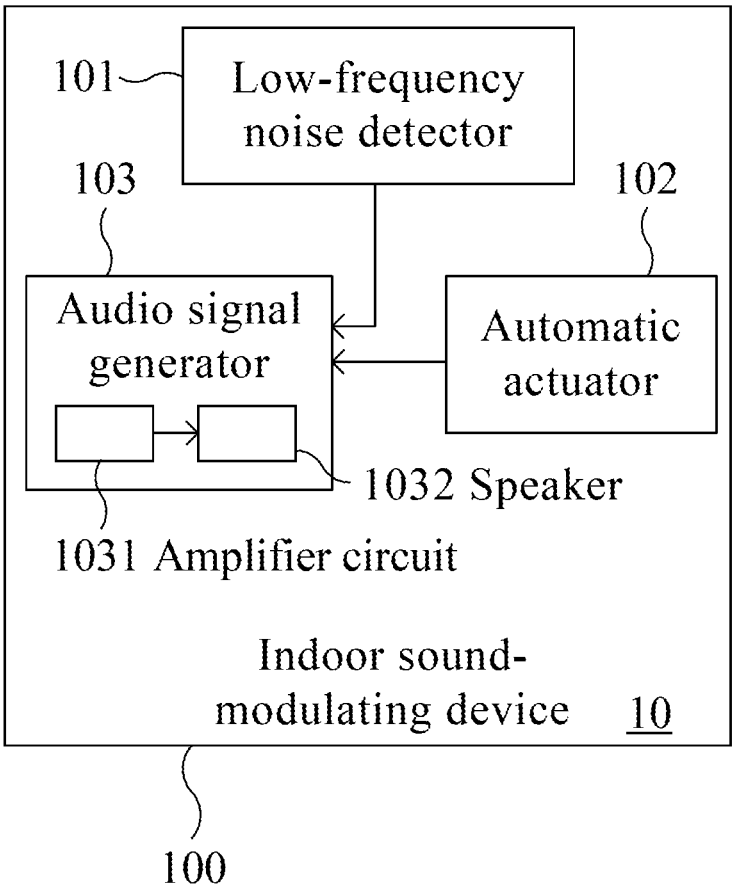
FIG. 1A is a functional block diagram illustrating an indoor sound-modulating device according an embodiment of the present disclosure.
Figure 1B:
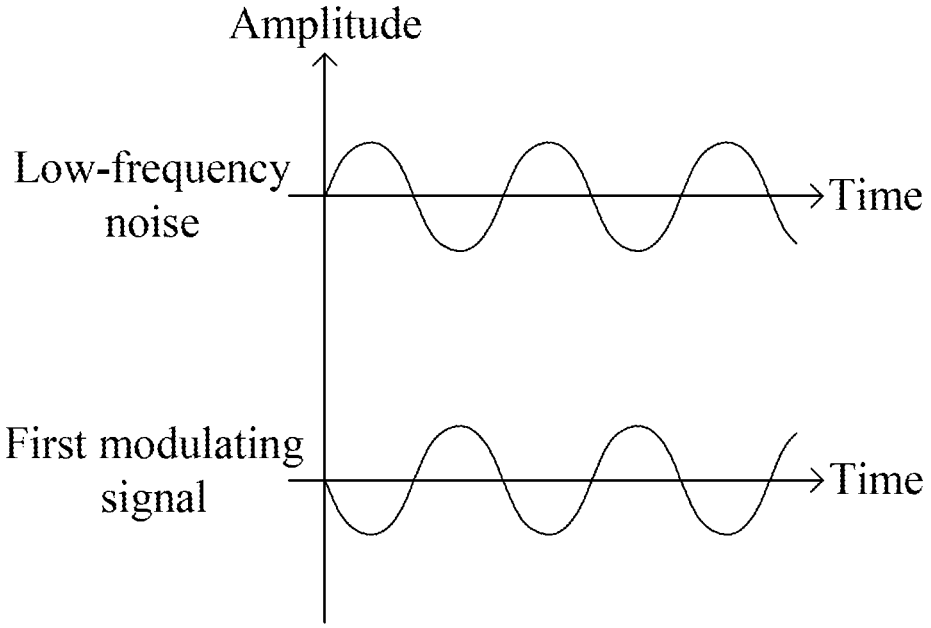
FIG. 1B illustrates waveforms of a first modulating signal generated by the low-frequency noise detector and low-frequency noise.

Please refer to FIG. 1A, a functional block diagram illustrating an indoor sound-modulating device according an embodiment of the present disclosure. The indoor sound-modulating device 10 mainly includes a low-frequency noise detector 101, an automatic actuator 102 and an audio signal generator 103. The low-frequency noise detector 101, the automatic actuator 102 and the audio signal generator 103 may be disposed in a single housing 100. The low-frequency noise detector 101 detects low-frequency noise and generates a first modulating signal in response to the detected low-frequency noise. The first modulating signal and the detected low-frequency noise have similar waveforms but they are in antiphase. The waveforms are exemplified in FIG. 1B. The automatic actuator 102 generates a second modulating signal in response to a predetermined state. The audio signal generator 103 is in communication with the low-frequency noise detector 101 and the audio signal generator 103. The audio signal generator 103 may include an amplifier circuit 1031 and a speaker 1032. The audio signal generator 103 generates a low-frequency audio signal for eliminating the low-frequency noise in response to the first modulating signal. The low-frequency audio signal and the detected low-frequency noise have similar waveforms but they are in antiphase. The low-frequency audio signal has a frequency ranging from 20 Hz to 350 Hz. The audio signal generator 103 further generates a high-frequency repellent audio signal in response to the second modulating signal. The high-frequency repellent audio signal has a frequency not less than (greater than or equal to) 8000 Hz and an intensity not more than (less than or equal to) 60 dB. The low-frequency audio signal can eliminate the low-frequency noise by destructive interference to provide a quiet interior environment. The indoor low-frequency noise may involve operation of air conditioning or refrigerators and automobiles/motorcycles on streets. The high-frequency repellent audio signal can make nearby people feel uncomfortable and urge them to leave the area.

Figure 2:
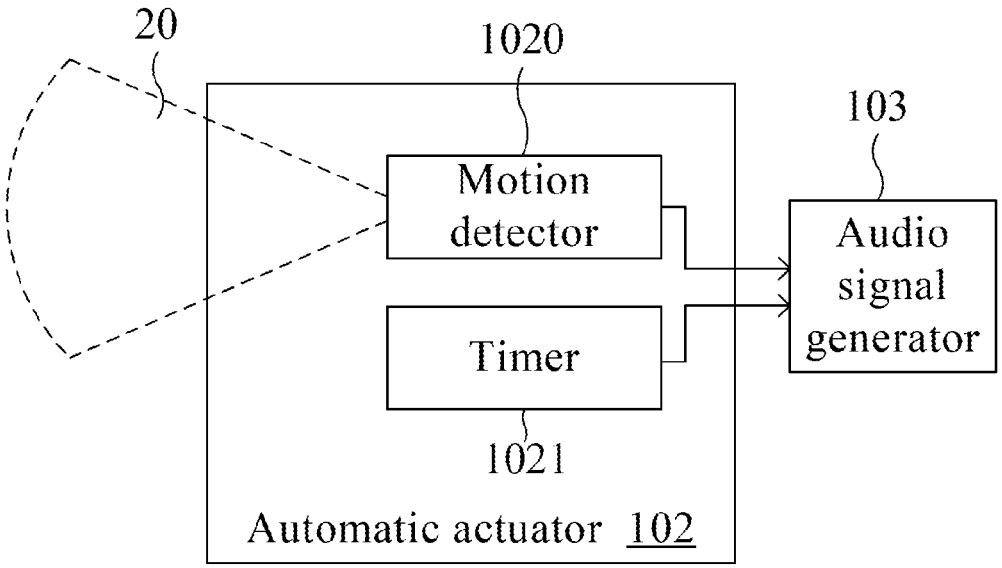
FIG. 2 is a functional block diagram illustrating an automatic actuator of the indoor sound-modulating device according to the present disclosure.

Please refer to FIG. 2, a functional block diagram illustrating the automatic actuator of the indoor sound-modulating device according to the present disclosure. The automatic actuator 102 mainly includes a motion detector 1020 and a timer 1021, both of which are in communication with the audio signal generator 103. The motion detector 1020 detects whether a moving object presents within a specific region 20. A first predetermined state represents that a moving object is detected. If an object is moving within the specific region (detected region) 20 and detected by the motion detector 1020, the detection result meets the first predetermined state and the motion detector 1020 generates the second modulating signal. Specifically, the motion detector 1020 may be implemented with an infrared (IR) sensor, an ultrasonic sensor or video monitoring system with image analysis function. When someone is moving within the detected region 20, the motion detector 1020 actively issues the second modulating signal to drive the audio signal generator 103 to generate the high-frequency repellent audio signal so as to make him or her uncomfortable and urge him or her to leave the area. Thus, the indoor sound-modulating device 10 further has anti-theft effect. A second predetermined state represents a specific period of time. In the specific period of time, the timer 1021 judges that the second predetermined state is met and issues the second modulating signal to drive the audio signal generator 103 to generate the high-frequency repellent audio signal. For example, the specific period of time is half an hour before closing hours of a public place, e.g. restaurant or store. Thus, the indoor sound-modulating device 10 will automatically generate the high-frequency repellent audio signal before the closing time to make the customers to leave the place much quickly and efficiently. The high-frequency repellent audio signal has a frequency not less than 8000 Hz and an intensity not more than 60 dB. The high-frequency repellent audio signal may be shown as any proper kind of sound. Furthermore, the controlled intensity of the high-frequency repellent audio signal will not frighten or scare the customers. In an embodiment, the automatic actuator 102 of the present disclosure may include only one of the motion detector 1020 and the timer 1021. The detailed structure, operation and principle of this embodiment are not described again.

In another embodiment, the indoor sound-modulating device 10 includes the low-frequency noise detector 101 and the audio signal generator 103, but the automatic actuator 102 is omitted. In this condition, the indoor sound-modulating device 10 can eliminate the low-frequency noise.

In another embodiment, the indoor sound-modulating device 10 includes the automatic actuator 102 and the audio signal generator 103, but the low-frequency noise detector 101 is omitted. In this condition, the indoor sound-modulating device 10 can automatically actuate the repellent function.

It is to be noted that the present disclosure is not limited to the above-described embodiments. The indoor sound-modulating device may be integrated into many kinds of hardware, e.g. television system, stereo system, surveillance system or fire protection system. The main structure is similar to that described above and redundant description is not given herein.

In conclusion, the present disclosure provides an indoor sound-modulating device capable of generating a low-frequency audio signal for eliminating low-frequency noise and/or a high-frequency repellent audio signal in response to specific state to achieve eliminating noise and/or repelling people in corresponding conditions.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An indoor sound-modulating device comprising:

a low-frequency noise detector for detecting low-frequency noise and generating a first modulating signal in response to the detected low-frequency noise;

an automatic actuator issuing a second modulating signal in response to a predetermined state; and an audio signal generator in communication with the low-frequency noise detector and the automatic actuator, the audio signal generator generating a low-frequency audio signal for eliminating the low-frequency noise in response to the first modulating signal and generating a high-frequency repellent audio signal in response to the second modulating signal, the low-frequency audio signal having a frequency ranging from 20 Hz to 350 Hz, the high-frequency repellent audio signal having a frequency greater than or equal to 8000 Hz.

2. The indoor sound-modulating device according to claim 1, wherein the first modulating signal generated by the low-frequency noise detector and the low-frequency noise have similar waveforms in antiphase.

3. The indoor sound-modulating device according to claim 1, wherein the automatic actuator comprises a motion detector for detecting whether an object is moving within a specific region and generating the second modulating signal if the predetermined state is met according to the detected moving object.

4. The indoor sound-modulating device according to claim 1, wherein the automatic actuator comprises a timer for issuing the second modulating signal if the predetermined state representing a specific period of time is met.

5. The indoor sound-modulating device according to claim 1, wherein the audio signal generator comprises an amplifier circuit and a speaker, the high-frequency repellent audio signal having an intensity less than or equal to 60 dB.

6. An indoor sound-modulating device comprising:

a low-frequency noise detector for detecting low-frequency noise and generating a first modulating signal in response to the detected low-frequency noise; and an audio signal generator in communication with the low-frequency noise detector, the audio signal generator generating a low-frequency audio signal for eliminating the low-frequency noise in response to the first modulating signal, the low-frequency audio signal having a frequency ranging from 20 Hz to 350 Hz.

7. The indoor sound-modulating device according to claim 6, wherein the first modulating signal generated by the low-frequency noise detector and the low-frequency noise have similar waveforms in antiphase.

8. An indoor sound-modulating device comprising:

an automatic actuator issuing a second modulating signal in response to a predetermined state; and an audio signal generator in communication with the automatic actuator, the audio signal generator generating a high-frequency repellent audio signal in response to the second modulating signal, the high-frequency repellent audio signal having a frequency greater than or equal to 8000 Hz and having an intensity less than or equal to 60 dB.

9. The indoor sound-modulating device according to claim 8, wherein the automatic actuator comprises a motion detector for detecting whether an object is moving within a specific region and generating the second modulating signal if the predetermined state is met according to the detected moving object.

10. The indoor sound-modulating device according to claim 8, wherein the automatic actuator comprises a timer for issuing the second modulating signal if the predetermined state representing a specific period of time is met.

* * * * *